United States Patent [19]

Edwards

[11] Patent Number: 4,831,669

[45] Date of Patent: May 23, 1989

[54] PLUNGER SPLASH GUARD FOR A TOILET BOWL

[76] Inventor: Guy Edwards, 6201 Dolly Varden Rd., South Charleston, Ohio 45368

[21] Appl. No.: 180,557

[22] Filed: Apr. 12, 1988

[51] Int. Cl.[4] ..... E03D 11/00

[52] U.S. Cl. ..... 4/257; 4/255; 220/378

[58] Field of Search ..... 4/255–257, 4/661, 300.3; 220/378

[56] References Cited

U.S. PATENT DOCUMENTS 785,116 3/1905 Perry ..... 200/378 X
3,491,379 1/1970 Parrish ..... 4/661 X
4,238,860 12/1980 Dixon ..... 4/256
4,458,368 7/1984 Webb ..... 4/300.3 X

*Primary Examiner*—Henry J. Recla
*Assistant Examiner*—Robert Fetsuga
*Attorney, Agent, or Firm*—Fleit, Jacobson, Cohn & Price

[57] ABSTRACT

A splash guard for the open upper end of a toilet bowl to prevent water or similar liquid material from splashing out of the toilet bowl when unclogging the toilet by the use of a plunger, generally known as a "plumber's helper". The splash guard includes a generally flat plate sufficiently large to cover the open upper end of the toilet bowl and includes a flexible central diaphragm provided with an opening to receive and allow movement of a plunger handle whereby vertical movement of the plunger will not result in water splashing out of the open upper end of the toilet bowl.

6 Claims, 1 Drawing Sheet

PLUNGER SPLASH GUARD FOR A TOILET BOWL

BACKGROUND OF THE INVENTION

1. Field of the Invention

The present invention generally relates to a device that covers the open upper end of a toilet bowl in order to avoid splashing of water or similar liquid material from the toilet bowl when unclogging the toilet by the use of a plunger, generally known as a "plumber's helper". The splash guard includes a generally flat plate sufficiently large to cover the open upper end of the toilet bowl and includes a flexible central diaphragm provided with an opening to receive and allow movement of a plunger handle whereby vertical movement of the plunger will not result in water splashing out of the open upper end of the toilet bowl.

INFORMATION DISCLOSURE STATEMENT

Devices to prevent splashing when using a plunger to unclog a drain are generally well known. However, such known devices do not include the specific structure incorporated into the splash guard of the present invention.

SUMMARY OF THE INVENTION

An object of the present invention is to provide a plunger splash guard for a toilet bowl which includes a generally flexible diaphragm having a centrally disposed hole therein for closely receiving but enabling movement of the handle of a plunger generally known as a "plumber's helper".

Another object of the invention is to provide a splash guard in accordance with the preceding object in which the flexible diaphragm is provided with a peripheral frame connected to the upper surface thereof and a peripheral sealant member connected to the lower surface thereof both of which have large central openings to enable flexible movement of the diaphragm with the upper frame opening being somewhat smaller than the opening in the sealant member to enhance the flexibility of the diaphragm.

A further object of the invention is to provide a plunger splash guard for a toilet bowl in accordance with the preceding objects that effectively prevents water from being splashed out of the toilet bowl when using the plunger to unclog the drain with the structure being sufficiently rigid to be easily positioned on the upper surface of the toilet bowl and easily held in place by a foot or hand while the plunger is being operated by hand.

Still another object of the invention is to provide a plunger splash guard for a toilet bowl which is simple in construction, easy to use, effective in maintaining water interiorly of the toilet bowl and capable of use with very little training.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 2:
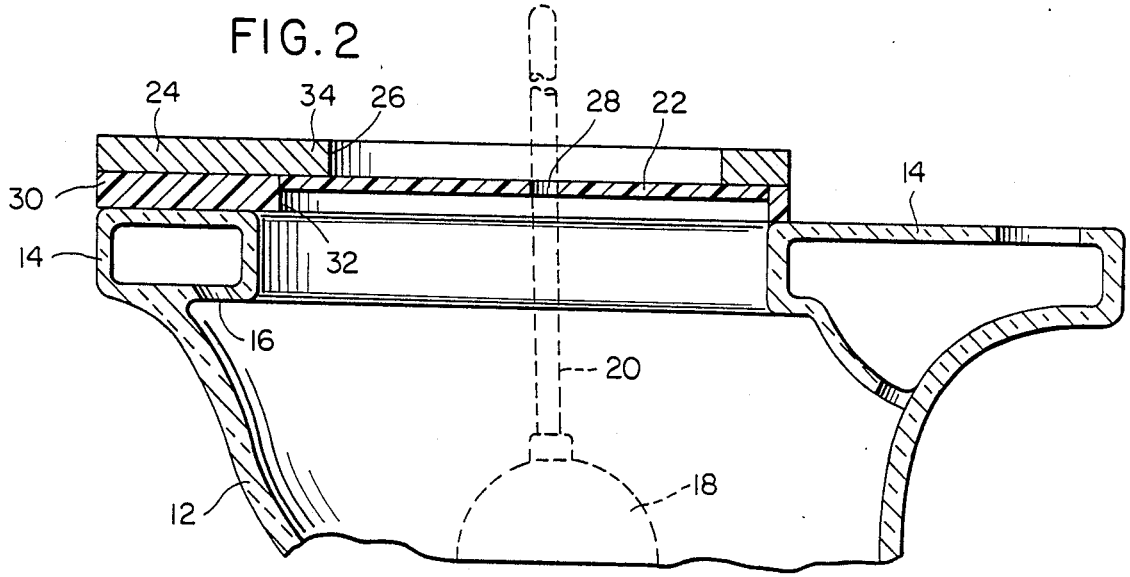
FIG. 2 is a sectional view of the splash guard and adjacent portions of the toilet bowl illustrating the structural relationships thereof together with the plunger illustrated in use position.
Figure 3:
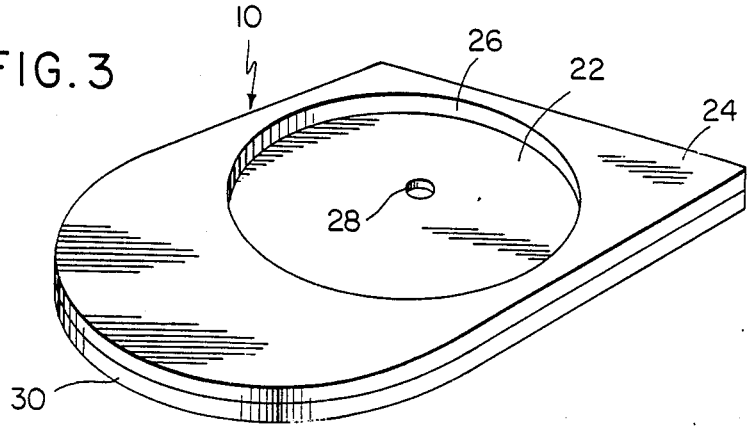
FIG. 3 is a perspective view of the splash guard.

The splash guard of the present invention is generally designated by the numeral 10 and in FIG. 2, the splash guard is illustrated in use on the open upper end of a toilet bowl 12 which usually includes a hollow annular rim member 14 provided with passageways 16 for discharging water onto the inner surface of the toilet bowl in a conventional manner. The toilet bowl is of conventional construction and forms no particular part of the present invention except for the association of the splash guard 10 with the toilet bowl 12. Also illustrated in FIG. 2 is a conventional plunger 18, commonly referred to as a "plumber's helper" with an elongated handle 20 projecting upwardly therefrom. The plunger is also conventional construction and may be of the vacuum cup shape or of spherical configuration in which the handle 20 is moved vertically during manipulation of the plunger to unclog the drain from the toilet bowl 12. When this is done, it frequently occurs that water will be discharged from the periphery of the plunger cup and splased out of the open top of the bowl 12 thus resulting in unsanitary conditions existing on the floor of the bathroom and also causing a mess which must be cleaned.

The splash guard 10 includes a diaphragm 22 constructed of rubber, plastic or similar elastomeric material having some degree of resiliency or elasticity and also being flexible with the material either being natural rubber, synthetic material or the like. The diaphragm 22 is generally of circular configuration and, in one embodiment of the invention, the thickness of the diaphragm of 1/16" has been found sufficient for purposes of flexibility and elasticity.

On the upper surface of the diaphragm 22, a frame 24 is provided which also is constructed of plastic, rubber or corrosion resistant material such as aluminum with the frame being substantially rigid. In one embodiment, the nominal thickness of the frame may be ¼" and the physical strength of the material includes sufficient rigidity to maintain the shape and configuration of the splash guard. The frame 24 includes an enlarged central opening 26 in alignment with a major portion of the diaphragm 22. The diaphragm is secured to or fastened to the frame 24 and completely closes the opening 26. Any suitable type of water resistant adhesive or other bonding method or mechanical connection and sealing method may be employed to connect the diaphragm 22 and the frame 24 so that these components become affixed. As illustrated, the central portion of the diaphragm 22 is provided with a hole 28 receiving the plunger handle 20 with the hole 28 also being generally centrally located with respect to the opening 26 in the frame 24 as illustrated in the drawings.

Affixed to the undersurface of the frame 24 and peripherally of the diaphragm 22 is a sealant member 30 which is constructed of conformable, cushiony material of resilient characteristics with the sealant member being external of the periphery of the diaphragm 22 but having an outer periphery coincident with the periphery of the frame 24 and an inner periphery spaced outwardly from the periphery of the opening 26 with the inner periphery defining an opening 32 which is larger than the opening 26. Any suitable water resistant adhesive or mechanical fastening or sealing arrangement may be provided for securing the sealant member 30 to the frame 24 and the diaphragm 22 so that these components, in effect, become unitary in construction. The sealant member 30 also may be constructed of any pliable material such as natural or synthetic rubber, soft plastic and the like and the undersurface of the sealant member 30 may be provided with a roughened or non-skid surface on its face which contacts the toilet bowl rim 14 to minimize lateral movement when the device is in use.

The hole 28 which receives the plunger handle is dimensioned to closely fit any standard toilet plunger handle and may be 9/16" in diameter. With the hole extending through the flexible diaphragm, the resiliency of the diaphragm conforms the hole to the plunger handle but yet allows the plunger handle to reciprocate vertically in its normal use beyond the flexure limits of the diaphragm and still frictionally seals the plunger handle against water splashing through the hole. This construction also enables some limited lateral movement of the plunger handle consistant with normal reciprocation of the plunger. The hole is generally in the center of the diaphragm and also generally in the center of the frame and situated the greatest distance from the front or rounded portion of the frame 24. The off center positioning of the hole is for perpendicular or vertical movement of the plunger with the flushing throat or outlet nexus situated in the toilet bowl so that when the splash guard is placed on the rim of the toilet bowl, the plunger 18 will be properly located in relation to the drain from the toilet bowl.

Figure 1:
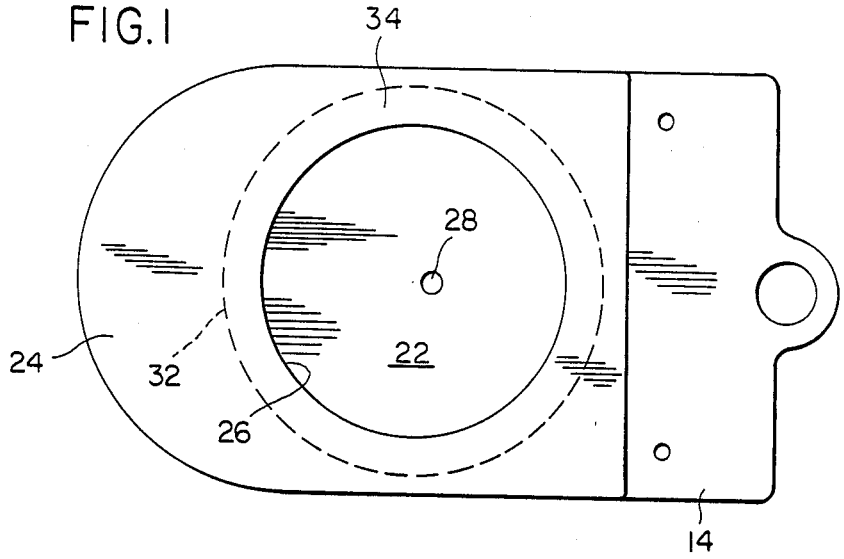
FIG. 1 is a top plan view of the splash guard of the present invention.

The opening 26 in the frame 24 is illustrated as circular in configuration but can be of other geometric or non-geometric configurations. In one embodiment of the invention, the opening 26 may have a diameter of approximately 10". However, the opening does have a dimension substantially smaller than the narrowest measurable dimentsion found in common toilet bowl rims. Thus, the opening 26 provides sufficient area within the frame 24 for flexure of the diaphragm 22 that is affixed to the frame 24. As illustrated in FIGS. 1 and 2, there is an annular area that is radially defined as the difference between the periphery of the opening 26 and the periphery of the opening 32 in the sealant member 30 with these openings being generally concentric and the radial difference being defined as an annular area 34 as illustrated in FIGS. 1 and 2. It is this annular area that forms the area in which the diaphragm 22 is secured to the frame 24.

The width of the frame 24 opposite to the curved end may be varied but in one embodiment of the invention is 14" and is at least as large as, but not necessarily limited to the maximum overall width of the toilet bowl dimension. This width has a function in providing a surface area extending laterally outward from the opening 32 and opening 26 to act as a containment barrier against water splash in this area. The length dimension of the frame from the front to rear also is variable to cover the major dimension of the common toilet bowl and also functions to cover toilet bowls that exceed the common length of standard toilet bowls with this length being 18" in one embodiment of the invention so that it can be adapted to various lengths of common toilet bowls.

The frame thickness also may be varied depending upon the type and quality of material used with one embodiment of the invention including a frame of ¼" in thickness. In use, the user may place his foot on top of the splash guard at the front to prevent skidding of the splash guard in relation to the toilet bowl and to counteract the forces induced by plunger action. Thus, if a metal frame is used, it need not be as thick as if a hard rubber or a plastic frame is used.

The sealant member 30 is constructed of a softer resilient material and may be of any desired thickness to provide adequate and effective sealing engagement with the bowl rim 14. The sealant member in one embodiment of the invention may be ¼" thick. The opening 32 is larger than the opening 26 and forms the outer dimension of the annular area 34 and this opening can, in one embodiment of the invention, be 12" in diameter although this not limitative. As indicated, the components are secured together by adhesive, bonding or other mechanical fastening arrangements but they can be constructed of one piece of material such as by molding or by using other known manufacturing techniques. The shape, form, quantity and quality of the materials, the dimensions and method of construction all can be varied to enable the use of conventional materials thereby rendering the device relatively inexpensive to manufacture but yet one which is effective for its particular purposes and easily used by those engaged in unclogging toilet bowls by the use of a plunger or "plumber's helper".

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A plunger splash guard for a toilet bowl comprising a generally flexible diaphragm constructed of relatively thin, resilient flexible material, frame means connected with said diaphragm and seal means connected with the diaphragm for sealing engagement with the top surface of the rim of a toilet bowl for forming a closure for the open upper end of the toilet bowl, said diaphragm including a hole formed therein for closely receiving the handle of a plunger when used in unclogging the drain of the toilet bowl to prevent splashing of liquid or similar material from the toilet bowl upwardly and outwardly of the open upper end thereof when the plunger handle is being reciprocated when unclogging the drain.

2. The structure as defined in claim 1 wherein said frame means is substantially rigid as compared to the diaphragm with the frame means generally conforming to the dimensional characteristics of the periphery of the rim of the toilet bowl for retaining the diaphragm in overlying relation to the drain area of the toilet bowl.

3. The structure as defined in claim 2 wherein said hole in the diaphragm is substantially centrally located with respect to the diaphragm and generally in alignment with the drain area of the toilet bowl for positioning the plunger in alignment with the drain from the toilet bowl.

4. The structure as defined in claim 3 wherein said diaphragm has a periphery extending beyond the inner periphery of the frame means, said inner periphery of the frame means being defined by an enlarged central opening providing a flexure area for the diaphragm with the periphery of the diaphragm extending beyond the periphery of the opening in the frame means and terminating inwardly from the outer periphery of the frame means.

5. The structure as defined in claim 4 wherein the seal means includes a sealant member extending peripherally along the bottom surface of the frame means with the outer periphery of the sealant member being coincidental to the periphery of the frame means, said sealant member including an inner periphery defining an opening around the periphery of the diaphragm and disposed radially outwardly of the inner periphery of the frame thereby forming an annular area of frame means overlying the diaphragm with that portion of the diaphragm radially outwardly of the inner periphery of the frame means being fixedly secured to the frame means.

6. In combination with a plunger having a handle by which the plunger can be manipulated when unclogging a toilet bowl drain by reciprocating the handle, a splash guard engaging the rim at the open upper end of a toilet bowl in sealed relation, said splash guard including a flexible diaphragm having a hole closely receiving said handle to enable movement of the handle, said diaphragm including a peripheral frame of more rigid construction than the diaphragm, said frame including resilient seal means on the lower surface for sealing engagement with said rim.

* * * * *